US012312721B2

(12) United States Patent
Hodges

(10) Patent No.: US 12,312,721 B2
(45) Date of Patent: May 27, 2025

(54) GARMENT DRAWSTRING MANIPULATION DEVICE

(71) Applicant: Alvin Hodges, Columbus, GA (US)

(72) Inventor: Alvin Hodges, Columbus, GA (US)

( * ) Notice: Subject to any disclaimer, the term of this patent is extended or adjusted under 35 U.S.C. 154(b) by 0 days.

(21) Appl. No.: 18/481,371

(22) Filed: Oct. 5, 2023

(65) Prior Publication Data

US 2024/0376653 A1 Nov. 14, 2024

Related U.S. Application Data

(60) Provisional application No. 63/500,818, filed on May 8, 2023.

(51) Int. Cl.

| | |
|---|---|
| ***D04D 11/00*** | (2006.01) |
| ***A41H 43/00*** | (2006.01) |
| ***D05B 91/00*** | (2006.01) |

(52) U.S. Cl.

CPC ..... *D04D 11/00* (2013.01); *A41H 43/00* (2013.01); *D05B 91/00* (2013.01)

(58) Field of Classification Search

CPC ..... D04D 11/00; D05B 91/00; D05B 91/02; A41H 43/00

See application file for complete search history.

(56) References Cited

U.S. PATENT DOCUMENTS 1,891,815 A 12/1932 Heidrich
3,434,590 A * 3/1969 Laughlin ..... D05B 91/14 223/109 R
3,885,719 A * 5/1975 Williams ..... D04D 11/00 223/103
5,447,260 A 9/1995 Beddow
5,785,215 A 7/1998 Hinkel
9,334,595 B2 5/2016 Archibeck
(Continued)

FOREIGN PATENT DOCUMENTS

CN 202397355 U * 8/2012
CN 203268452 U * 11/2013
(Continued)

OTHER PUBLICATIONS

Amazon (https://www.amazon.com/Aekvinks-Military-Flashlight-Chemlight-Organizer/dp/B09L87ZZPQ?th=1) (Year: 2021).*

*Primary Examiner* — Shaun R Hurley
(74) *Attorney, Agent, or Firm* — Brennan, Manna & Diamond, LLC

(57) ABSTRACT

A garment drawstring manipulation device is provided. The device is comprised of a connecting member comprised of at least one fastener, a first member comprised of at least one fastener, and a second member comprised of at least one fastener. The first and second members can be positioned on both sides of a garment such that a drawstring is positioned between the members. Then, both members can be rolled or pushed towards each other such that the fasteners secure the positions of the members on the connecting member and the members contact the drawstring. A user can continue pushing the members together while sliding the device, and the drawstring can be pushed by the members towards the opening of the waistband such that the drawstring can be pulled through the opening and return to its normal position.

11 Claims, 5 Drawing Sheets

(56) References Cited

U.S. PATENT DOCUMENTS

| | | | | |
|---|---|---|---|---|
| 2011/0101042 | A1 | 5/2011 | Ross | |
| 2020/0173071 | A1 * | 6/2020 | Papenfuss | D04D 7/06 |

FOREIGN PATENT DOCUMENTS

| | | | | | |
|---|---|---|---|---|---|
| CN | 203268453 | U | * | 11/2013 | |
| CN | 204445624 | U | * | 7/2015 | |
| DE | 202016005238 | U1 | * | 11/2016 | D04D 11/00 |

* cited by examiner

GARMENT DRAWSTRING MANIPULATION DEVICE

CROSS-REFERENCE TO RELATED APPLICATION

The present application claims priority to, and the benefit of, U.S. Provisional Application No. 63/500,818, which was filed on May 8, 2023, and is incorporated herein by reference in its entirety.

FIELD OF THE INVENTION

The present invention relates generally to the field of garment manipulating devices. More specifically, the present invention relates to a garment drawstring manipulation device that is comprised of a first member and a second member that can be pressed against a drawstring lost within a waistband (or other areas of a garment) and used to slide the drawstring out from the waistband via the drawstring opening. Accordingly, the present disclosure makes specific reference thereto. Nonetheless, it is to be appreciated that aspects of the present invention are also equally applicable to other like applications, devices, and methods of manufacture.

BACKGROUND

Many clothing items such as sweatpants, shorts, and hoodies, are equipped with drawstrings for sinching the clothing tighter in specific areas. These drawstrings are difficult to keep in place and often become pulled into the garment either by accident or while in the washing machine. However, retrieving the lost end of the drawstring can be an extremely tedious and frustrating process. During this process, the string often ends up pushed further inside the item or is damaged in the removal process, which is undesirable and may require that the garment is replaced.

Therefore, there exists a long-felt need in the art for a tool that can be used to retrieve a drawstring from within a garment. More specifically, there exists a long-felt need in the art for a garment drawstring manipulation device that can be used to retrieve a drawstring from within a garment without damaging the drawstring or the garment. Further, there exists a long-felt need in the art for a garment drawstring manipulation device that can be used to retrieve a drawstring from within a garment in an efficient and simple manner.

The subject matter disclosed and claimed herein, in one embodiment thereof, comprises a garment drawstring manipulation device. The device is comprised of a connecting member comprised of at least one fastener, a first member comprised of at least one fastener, and a second member comprised of at least one fastener. The first member can be positioned on one side of a garment and the second member can be positioned on the opposite side of the garment such that a drawstring is positioned between the members. Then, both members can be rolled or pushed towards each other such that the fasteners secure the positions of the members on the connecting member and the members contact the drawstring. A user can continue pushing the members together while sliding the device, and the drawstring can be pushed by the members towards the opening of the waistband such that the drawstring can be pulled through the opening and return to its normal position.

In this manner, the garment drawstring manipulation device of the present invention accomplishes all the foregoing objectives and provides a tool that can be used to retrieve a drawstring from within a garment. During use, the device can be used to retrieve a drawstring from within a garment without damaging the drawstring or the garment. In addition, the device does so in an efficient and simple manner.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a garment drawstring manipulation device designed to allow a user to retrieve a drawstring of a garment that has been lost inside the waistband (or other areas) of the garment. In different embodiments, the garment may be, but is not limited to, shorts, pants, hoodies, etc.

The device is comprised of a first member, a second member, and a connecting member which connects the first member and second member. In one embodiment, the member is comprised of at least one fastener that may surround the circumference of the member. The fastener allows the member to removably attach to at least one fastener of the connecting member in a repositionable manner. In a different embodiment, the first member may attach to the connecting member via at least one hinge. The hinge allows the member to articulate in a 180 (or less) range of motion relative to the connecting member. This allows the member to be moved towards a waistband (or other portion of a garment) such that the member contacts the drawstring stuck within the waistband (on a first side of the waistband).

The second member is comprised of at least one fastener that may surround the circumference of the member. The fastener allows the member to removably attach to at least one fastener of the connecting member in a repositionable manner. In a different embodiment, the second member may attach to the connecting member via at least one hinge. The hinge allows the member to articulate in a 180 (or less) range of motion relative to the connecting member. This allows the member to be moved towards a waistband (or other portion of a garment) such that the member contacts the drawstring stuck within the waistband (on a second side of the waistband).

The present invention is also comprised of a first method of using the device. First, a device is provided comprised of a connecting member comprised of at least one fastener, a first member comprised of at least one fastener, and a second member comprised of at least one fastener. Then, the first member can be positioned on one side of a garment, in this example a garment waistband, and the second member can be positioned on the opposite side of the garment such that a drawstring is positioned between the members. Then, both members can be rolled or pushed towards each other such that the fasteners secure the positions of the members on the connecting member and the members contact the drawstring. Next, a user can continue pushing the members together while sliding the device, and the drawstring can be pushed by the members towards the opening of the waistband such that the drawstring can be pulled through the opening and return to its normal position.

The present invention is also comprised of a second method of using the device. First, a device is provided comprised of a connecting member comprised of a first member that attaches to the member via a hinge and a second member that attaches to the member via a second hinge. Then, the first member can be positioned on one side of a garment, in this example a garment waistband, and the second member can be positioned on the opposite side of the garment such that a drawstring is positioned between the members. Then, both members can be rolled or pushed towards each other via movement of the hinges such that the members contact the drawstring. Next, a user can continue pushing the members together while sliding the device, and the drawstring can be pushed by the members towards the opening of the waistband such that the drawstring can be pulled through the opening and return to its normal position.

Accordingly, the garment drawstring manipulation device of the present invention is particularly advantageous as it provides a tool that can be used to retrieve a drawstring from within a garment. During use, the device can be used to retrieve a drawstring from within a garment without damaging the drawstring or the garment. In addition, the device does so in an efficient and simple manner. In this manner, the garment drawstring manipulation device overcomes the limitations of existing methods of retrieving a drawstring from within a garment known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
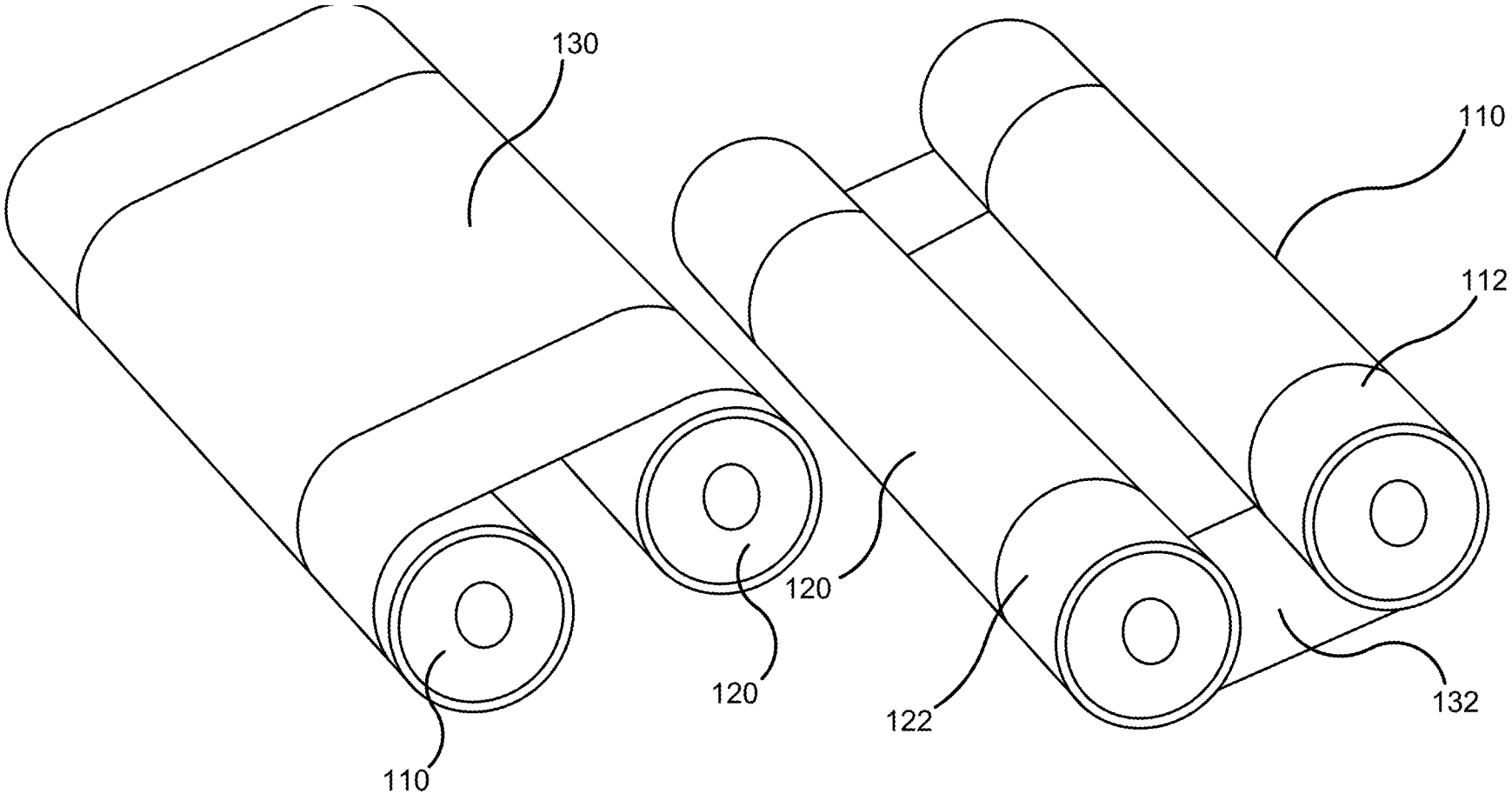
FIG. 1 illustrates a top and bottom perspective view of one potential embodiment of a garment drawstring manipulation device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a tool that can be used to retrieve a drawstring from within a garment. More specifically, there exists a long-felt need in the art for a garment drawstring manipulation device that can be used to retrieve a drawstring from within a garment without damaging the drawstring or the garment. Further, there exists a long-felt need in the art for a garment drawstring manipulation device that can be used to retrieve a drawstring from within a garment in an efficient and simple manner.

The present invention, in one exemplary embodiment, is comprised of a garment drawstring manipulation device comprised of a first member, a second member, and a connecting member which connects the first member and second member. In one embodiment, the member is comprised of at least one fastener that may surround the circumference of the member which allows the member to removably attach to at least one fastener of the connecting member in a repositionable manner. In a different embodiment, the first member may attach to the connecting member via at least one hinge. The hinge allows the member to articulate in a 180 (or less) range of motion relative to the connecting member. This allows the member to be moved towards a waistband (or other portion of a garment) such that the member contacts the drawstring stuck within the waistband (on a first side of the waistband).

The second member is comprised of at least one fastener that may surround the circumference of the member which allows the member to removably attach to at least one fastener of the connecting member in a repositionable manner. In a different embodiment, the second member may attach to the connecting member via at least one hinge. The hinge allows the member to articulate in a 180 (or less) range of motion relative to the connecting member. This allows the member to be moved towards a waistband (or other portion of a garment) such that the member contacts the drawstring stuck within the waistband (on a second side of the waistband).

The present invention is also comprised of a first method of using the device. First, a device is provided comprised of a connecting member comprised of at least one fastener, a first member comprised of at least one fastener, and a second member comprised of at least one fastener. Then, the first member can be positioned on one side of a garment, in this example a garment waistband, and the second member can be positioned on the opposite side of the garment such that a drawstring is positioned between the members. Then, both members can be rolled or pushed towards each other such that the fasteners secure the positions of the members on the connecting member and the members contact the drawstring. Next, a user can continue pushing the members together while sliding the device, and the drawstring can be pushed by the members towards the opening of the waistband such that the drawstring can be pulled through the opening and return to its normal position.

The present invention is also comprised of a second method of using the device. First, a device is provided comprised of a connecting member comprised of a first member that attaches to the member via a hinge and a second member that attaches to the member via a second hinge. Then, the first member can be positioned on one side of a garment, in this example a garment waistband, and the second member can be positioned on the opposite side of the garment such that a drawstring is positioned between the members. Then, both members can be rolled or pushed towards each other via movement of the hinges such that the members contact the drawstring. Next, a user can continue pushing the members together while sliding the device, and the drawstring can be pushed by the members towards the opening of the waistband such that the drawstring can be pulled through the opening and return to its normal position.

Accordingly, the garment drawstring manipulation device of the present invention is particularly advantageous as it provides a tool that can be used to retrieve a drawstring from within a garment. During use, the device can be used to retrieve a drawstring from within a garment without damaging the drawstring or the garment. In addition, the device does so in an efficient and simple manner. In this manner, the garment drawstring manipulation device overcomes the limitations of existing methods of retrieving a drawstring from within a garment known in the art.

Referring initially to the drawings, FIG. 1 illustrates a top and bottom perspective view of one potential embodiment of a garment drawstring manipulation device 100 of the present invention in accordance with the disclosed architecture. The device 100 is designed to allow a user to retrieve a drawstring 30 of a garment 10 that has been lost inside the waistband 20 (or other areas) of the garment 10. In different embodiments, the garment 10 may be, but is not limited to, shorts, pants, hoodies, etc.

The device 100 is comprised of a first member 110, a second member 120, and a connecting member 130 which connects the first member 110 and second member 130. The first member 110 is preferably cylindrical in shape. However, the member 110 may be any shape in different embodiments. In one embodiment, the member 110 is comprised of at least one fastener 112 that may surround the circumference of the member 110. The fastener 112 allows the member 110 to removably attach to at least one fastener 132 of the connecting member 130 in a repositionable manner. The fasteners 112, 132 may be any type of reciprocating fastener known in the art such as, but not limited to, magnet, snap button, etc. However, the fasteners 112, 132 are preferably hook and loop fasteners.

Figure 2:
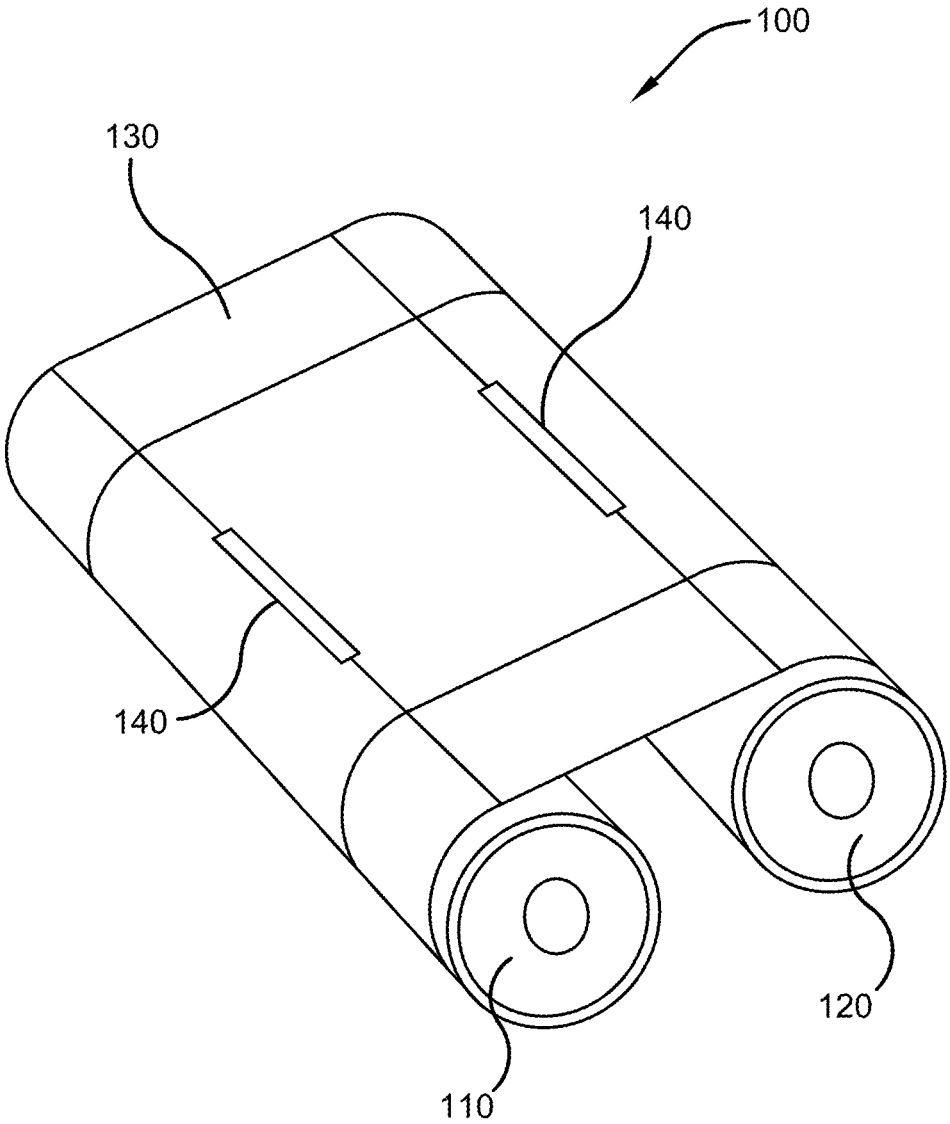
FIG. 2 illustrates a top-perspective view of one potential embodiment of a garment drawstring manipulation device of the present invention in accordance with the disclosed architecture.
Figure 3:
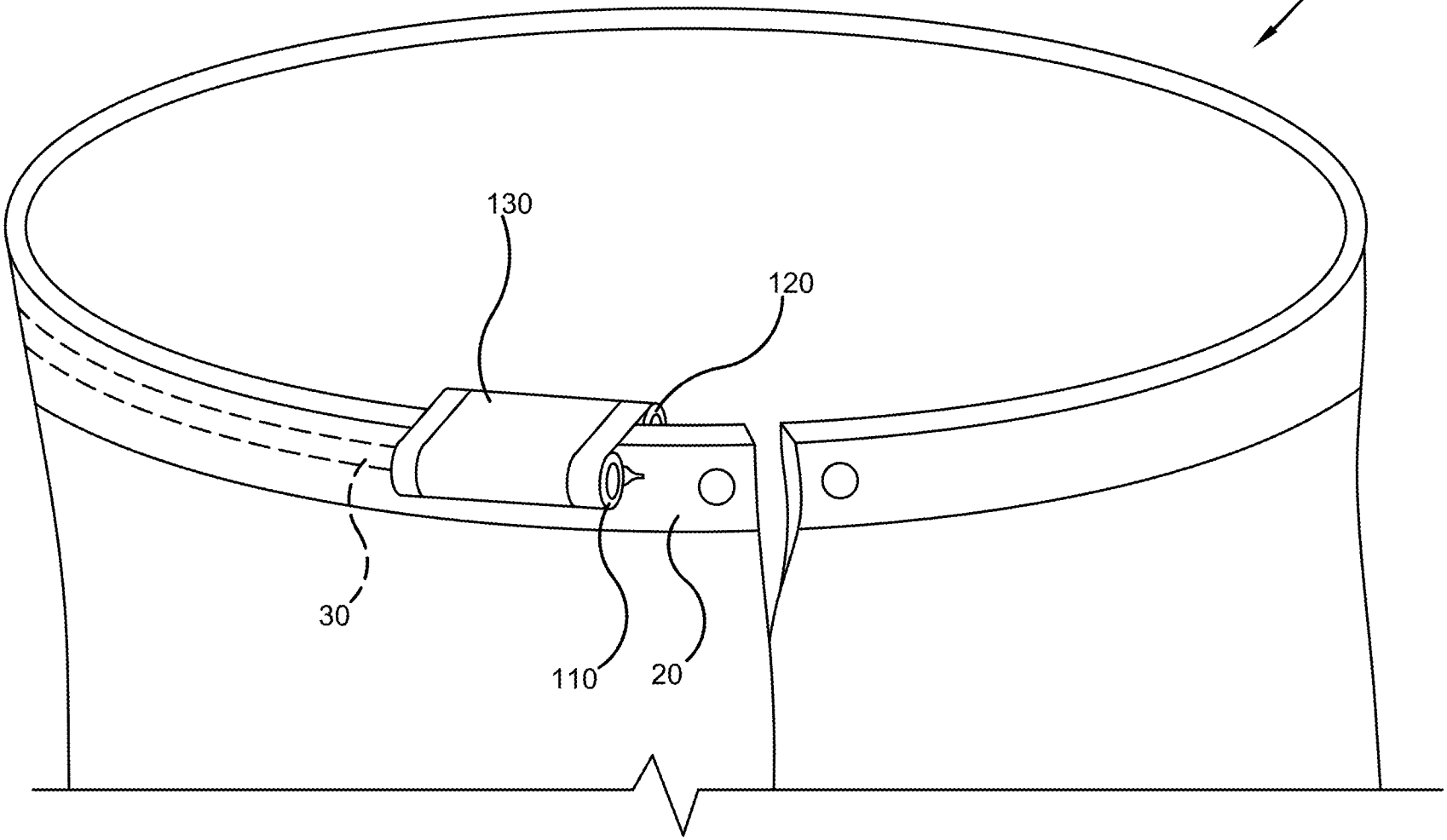
FIG. 3 illustrates a perspective view of one potential embodiment of a garment drawstring manipulation device of the present invention while being used to retrieve a drawstring trapped within the waistband of a garment in accordance with the disclosed architecture.

In a different embodiment, the first member 110 may attach to the connecting member 130 via at least one hinge 140, as seen in FIG. 2. The hinge 140 allows the member 110 to articulate in a 180 (or less) range of motion relative to the connecting member 130. This allows the member 110 to be moved towards a waistband 20 (or other portion of a garment 10) such that the member 110 contacts the drawstring 30 stuck within the waistband 20 (on a first side of the waistband 20). In an embodiment with the fasteners 122, 132 as described above, the member 130 may be flexible such that member 130 can be rolled around the member 110 such that the distance between the two members 110, 120 decreases such that both members 110, 120 contact the waistband 20 (or other portion of a garment 10), as seen in FIG. 3.

The second member 110 is preferably cylindrical in shape. However, the member 120 may be any shape in different embodiments. In one embodiment, the member 120 is comprised of at least one fastener 122 that may surround the circumference of the member 122. The fastener 122 allows the member 120 to removably attach to at least one fastener 132 of the connecting member 130 in a repositionable manner. The fasteners 112, 132 may be any type of reciprocating fastener known in the art such as, but not limited to, magnet, snap button, etc. However, the fasteners 112, 132 are preferably hook and loop fasteners.

In a different embodiment, the second member 120 may attach to the connecting member 130 via at least one hinge 140, as seen in FIG. 2. The hinge 140 allows the member 120 to articulate in a 180 (or less) range of motion relative to the connecting member 130. This allows the member 120 to be moved towards a waistband 20 (or other portion of a garment 10) such that the member 120 contacts the drawstring 30 stuck within the waistband 20 (on a second side of the waistband 20). In an embodiment with the fasteners 122, 132 as described above, the member 130 may be flexible such that member 130 can be rolled around the member 120 such that the distance between the two members 110, 120 decreases such that both members 110, 120 contact the waistband 20 (or other portion of a garment 10), as seen in FIG. 3.

Figure 4:
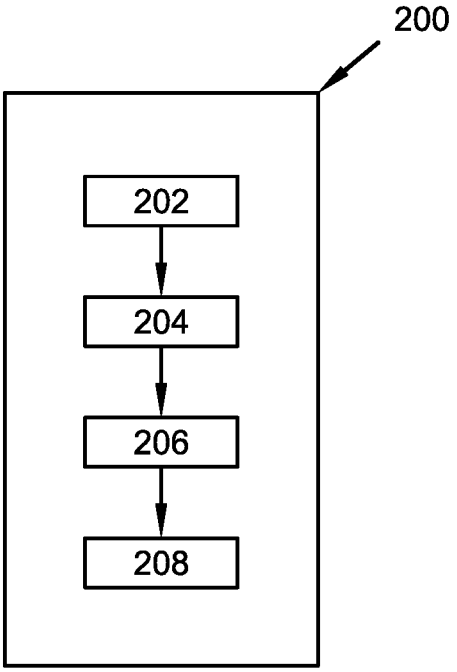
FIG. 4 illustrates a flowchart of a method of using one potential embodiment of a garment drawstring manipulation device of the present invention in accordance with the disclosed architecture.

The present invention is also comprised of a method of using 200 the device 100, as seen in FIG. 4. First, a device 100 is provided comprised of a connecting member 130 comprised of at least one fastener 132, a first member 110 comprised of at least one fastener 112, and a second member 120 comprised of at least one fastener 122 [Step 202]. Then, the first member 110 can be positioned on one side of a garment 10, in this example a garment 10 waistband 20, and the second member 120 can be positioned on the opposite side of the garment 10 such that a drawstring 30 is positioned between the members 110, 120 [Step 204]. Then, both members 110, 120 can be rolled or pushed towards each other such that the fasteners 112, 122, 132 secure the positions of the members 110, 120 on the connecting member 130 and the members 110, 120 contact the drawstring 30 [Step 206]. Next, a user can continue pushing the members 110, 120 together while sliding the device 100, and the drawstring 30 can be pushed by the members 110, 120, towards the opening 22 of the waistband 20 (or other similar openings of any garment type) such that the drawstring 30 can be pulled through the opening 22 and return to its normal position [Step 208].

Figure 5:
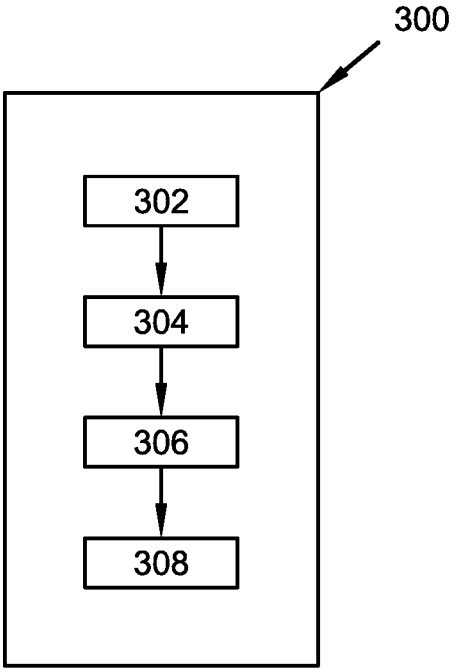
FIG. 5 illustrates a flowchart of a method of using one potential embodiment of a garment drawstring manipulation device of the present invention in accordance with the disclosed architecture.

The present invention is also comprised of a second method of using 300 the device 100, as seen in FIG. 5. First, a device 100 is provided comprised of a connecting member 130 comprised of a first member 110 that attaches to the member 130 via a hinge 140 and a second member 120 that attaches to the member 130 via a second hinge 140 [Step 302]. Then, the first member 110 can be positioned on one side of a garment 10, in this example a garment 10 waistband 20, and the second member 120 can be positioned on the opposite side of the garment such that a drawstring 30 is positioned between the members 110, 120 [Step 304]. Then, both members 110, 120 can be rolled or pushed towards each other via movement of the hinges 140 such that the members 110, 120 contact the drawstring 30 [Step 306]. Next, a user can continue pushing the members 110, 120 together while sliding the device 100, and the drawstring 30 can be pushed by the members 110, 120, towards the opening 22 of the waistband 20 (or other similar openings of any garment type) such that the drawstring 30 can be pulled through the opening 22 and return to its normal position [Step 308].

Certain terms are used throughout the following description and claims to refer to particular features or components. As one skilled in the art will appreciate, different persons, may refer to the same feature or component by different names. This document does not intend to distinguish between components or features that differ in name but not structure or function. As used herein "garment drawstring manipulation device" and "device" are interchangeable and refer to the garment drawstring manipulation device 100 of the present invention.

Notwithstanding the foregoing, the garment drawstring manipulation device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the garment drawstring manipulation device 100 as shown in the FIGS. are for illustrative purposes only, and that many other sizes and shapes of the garment drawstring manipulation device 100 are well within the scope of the present disclosure. Although the dimensions of the garment drawstring manipulation device 100 are important design parameters for user convenience, the garment drawstring manipulation device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A garment drawstring manipulation device comprising:

a connecting member comprised of a first fastener;

a first member comprised of a cylindrical shape and having a second fastener, wherein the second fastener surrounds the circumference of the first member; and a second member comprised of a third fastener; and wherein the second fastener is attachable to the first fastener to connect the first member to the connecting member;

wherein the third fastener is attachable to the first fastener to connect the second member to the connecting member opposite to the first member; and wherein the first and second members are configured to engage opposing sides of a drawstring within a garment so that the drawstring is contacted through the garment and is movable through the garment when the garment drawstring manipulation device is moved towards an opening in the garment to push the drawstring through the opening.

2. The garment drawstring manipulation device of claim 1, wherein the second member is comprised of a cylindrical shape.

3. The garment drawstring manipulation device of claim 2, wherein the third fastener surround the circumference of the second member.

4. The garment drawstring manipulation device of claim 1, wherein the connecting member is comprised of a flexible material.

5. The garment drawstring manipulation device of claim 1, wherein the second fastener and the third fastener are comprised of a hook fastener or a loop fastener.

6. The garment drawstring manipulation device of claim 1, wherein the first fastener is comprised of a hook fastener or a loop fastener.

7. A method of using a garment drawstring manipulation device, the method comprising the following steps:

providing a garment drawstring manipulation device comprised of a connecting member, a first member attached to the connecting member, and a second member attached to the connecting member;

positioning the first member on a first side of a garment and positioning the second member on a second side of the garment such that a drawstring of the garment is positioned between the first member and the second member;

pushing the first member towards the second member such that the members contact the drawstring through the garment; and sliding the garment drawstring manipulation device towards an opening of the garment to push the drawstring through the opening.

8. The method of using a garment drawstring manipulation device of claim 7, wherein the first member attaches to the connecting member via a first hinge and the second member attaches to the connecting member via a second hinge.

9. The method of using a garment drawstring manipulation device of claim 7, wherein the first member attaches to a first fastener of the connecting member via a second fastener and the second member attaches to the first fastener of the connecting member via a third fastener.

10. The method of using a garment drawstring manipulation device of claim 9, wherein the first fastener is comprised of a hook fastener or a loop fastener.

11. The method of using a garment drawstring manipulation device of claim 9, wherein the second fastener and the third fastener are comprised of a hook fastener or a loop fastener.

* * * * *